United States Patent [19]

Fotheringham

[11] Patent Number: 4,690,610

[45] Date of Patent: Sep. 1, 1987

[54] LIFT MAST TRANSPORT ARRANGEMENT

[75] Inventor: James R. Fotheringham, Willowick, Ohio

[73] Assignee: Caterpillar Industrial Inc., Mentor, Ohio

[21] Appl. No.: 855,866

[22] Filed: Apr. 24, 1986

[51] Int. Cl.[4] ..... B66F 17/00

[52] U.S. Cl. ..... 414/631; 414/663

[58] Field of Search ..... 414/495, 628–631, 414/540, 541, 662, 663, 668

[56] References Cited

U.S. PATENT DOCUMENTS

| | | | |
|---|---|---|---|
| 3,031,091 | 4/1962 | Erickson . | |
| 3,212,654 | 10/1965 | Dolphin | 414/663 X |
| 3,240,008 | 3/1966 | McMollen . | |
| 3,306,481 | 2/1967 | Bowman-Shaw | 414/631 |
| 3,565,273 | 2/1971 | Hahn | 414/631 |
| 3,616,953 | 11/1971 | Shaffer | 414/631 |
| 4,439,102 | 3/1984 | Allen | 414/631 X |

FOREIGN PATENT DOCUMENTS

| | | | |
|---|---|---|---|
| 238097 | 5/1964 | Austria | 414/631 |
| 1261796 | 2/1968 | Fed. Rep. of Germany | 414/631 |
| 2331985 | 1/1974 | Fed. Rep. of Germany | 414/631 |
| 2417645 | 10/1975 | Fed. Rep. of Germany . | |
| 1177307 | 4/1959 | France . | |
| 2261217 | 9/1975 | France . | |
| 2508885 | 1/1983 | France . | |
| 22270 | 2/1977 | Japan | 414/628 |
| 1159710 | 7/1969 | United Kingdom . | |

*Primary Examiner*—Peter A. Aschenbrenner
*Attorney, Agent, or Firm*—Alan J. Hickman

[57] ABSTRACT

Lift mast transporting arrangements frequently encounter loading which is detrimental to its operation and life. A transport device connects a lift mast assembly to first and second spaced apart guide rails and guides movement of the lift mast assembly along the guide rails, a power device having a shaft moves the transport device along the first and second guide rails between first and second spaced apart positions, and a coupling connects the power device to the transport device and provides a preselected amount of free movement of the transport device relative to the shaft and in directions transverse of the first and second guide rails. Thus, the aforementioned problems related to loading of lift mast transport arrangement is alleviated. The lift mast transporting arrangement is particularly suited for use on a material handling vehicle.

20 Claims, 5 Drawing Figures

LIFT MAST TRANSPORT ARRANGEMENT

TECHNICAL FIELD

This invention relates generally to a transport arrangement for a lift mast assembly, and more particularly, to a transport arrangement for guiding and driving a lift mast assembly between spaced apart locations on and longitudinal of a material handling frame.

BACKGROUND ART

Material handling vehicles, and particularly those known as reach trucks, have a lift mast mounted thereon which is longitudinally movable on the vehicle between spaced apart locations. Typically, the lift mast assembly is guided for longitudinal movement by chains, rollers, and the like engaged with spaced apart frame side members which extend in a longitudinal direction relative to the longitudinal axis of the vehicle. The guide rollers and chains engage the spaced apart frame side members in a manner so that the mast is movable along the vehicle axis and to some degree in directions transverse the vehicle axis to accommodate manufacturing tolerance build up. Often excessive play in directions transverse the movement of the lift mast assembly along the frame side members will permit cocking, skewing and other movements of the lift mast which are detrimental to the performance and life of the chains, rollers, and associated componentry. Representative examples of different ways of connecting the lift mast assembly to the vehicle for longitudinal movement along spaced apart frame members as discussed above are shown in U.S. Pat. No. 2,320,601 to R. C. Howell dated June 1, 1943, U.S. Pat. No. 2,667,985 to H. D. Woughter dated Feb. 2, 1954, U.S. Pat. No. 2,997,194 to A. E. R. Arnot dated Aug. 22, 1961, and U.S. Pat. No. 3,240,372 to J. E. Joyce et al. dated Mar. 15, 1966.

In order to move the lift mast assembly along the spaced apart side members of the vehicle frame, a suitable drive mechanism must be provided. Heretofore mentioned U.S. Pat. No. 2,667,985 to H. D. Woughter dated Feb. 2, 1954 utilizes drive chains, sprockets, and an electric motor to move the lift mast longitudinally relative to the vehicle, and aforementioned U.S. Pat. No. 2,320,601 to R. C. Howell dated June 1, 1943 utilizes a hydraulic jack connected between the vehicle frame and the lift mast assembly for propelling the lift mast along the spaced apart side members and longitudinally relative to the vehicle. Each of these drive arrangements are complicated, expensive, noisy, require a substantial amount of space on the vehicle, and do not precisely and smoothly position the lift mast along the side frame members.

Screw drives have been utilized to elevationally move lifting devices. Typically, screw drives are connected between a fixed member and a movable member and elevate the movable member in response to rotation of the screw. Examples of conventional lifting apparatuses having screw drives are shown in U.S. Pat. No. 2,663,929 to L. M. Carpenter dated Dec. 29, 1953, and U.S. Pat. No. 3,309,060 to J. Villars dated Mar. 14, 1967. In each of these patents, the screw drives are subjected to side loading forces which are transferred from the load being lifted to the lifting device and to the screw shaft. As a result, these side loading forces cause premature wear and ultimately failure of the screw and associated screw drive componentry. As a result, screw drive arrangements for lifting loads have seen only limited use and limited success.

Because a screw drive is capable of accurately and precisely positioning the driven element along its length, it is a desirable way of moving a lift mast assembly along the longitudinal vehicle axis. However, in order to be able to successfully utilize a screw drive, the problems associated with side loading the screw drive must be reduced to an acceptable level. The solution to this problem is complicated even more due to the fact that a controlled amount of movement of the lift mast assembly transverse the longitudinal axis of the vehicle must be provided to accommodate manufacturing and assembly tolerance stack up, and the like.

DISCLOSURE OF THE INVENTION

In an aspect of the present invention, a material handling vehicle has a frame having first and second spaced apart end portions and a longitudinal vehicle axis extending between the first and second end portions. A first guide rail is connected to the frame and substantially parallel to the longitudinal vehicle axis, and a second guide rail is connected to the frame at a location spaced from the first guide rail and substantially parallel to the first guide rail. A transport device connects a lift mast assembly to the first and second guide rails and guides movement of the lift mast assembly along the first and second guide rails in a direction substantially parallel to the longitudinal vehicle axis, and a power device moves the transport means along the first and second guide rails between a first position at which the lift mast assembly is adjacent the frame first end portion and a second position at which the lift mast assembly is spaced from the first position and between the first and second end portions. A coupling device connects the power device to the transport device and provides a preselected amount of free movement of the transport device relative to the power device in directions substantially transverse the guide rails.

BEST MODE FOR CARRYING OUT THE INVENTION

Figure 1:
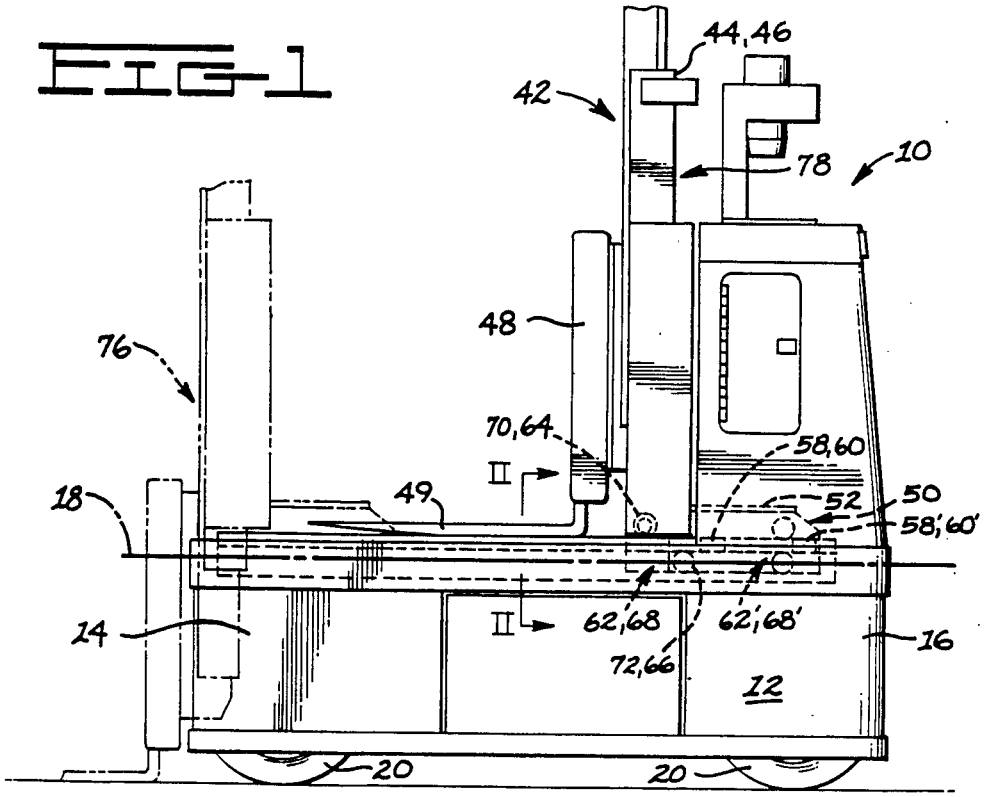
FIG. 1 is a partial diagrammatic side elevational view of a material handling vehicle showing a lift mast mounted thereon and movable between a first position as shown in phantom lines, and a second position as shown in solid lines.
Figure 2:
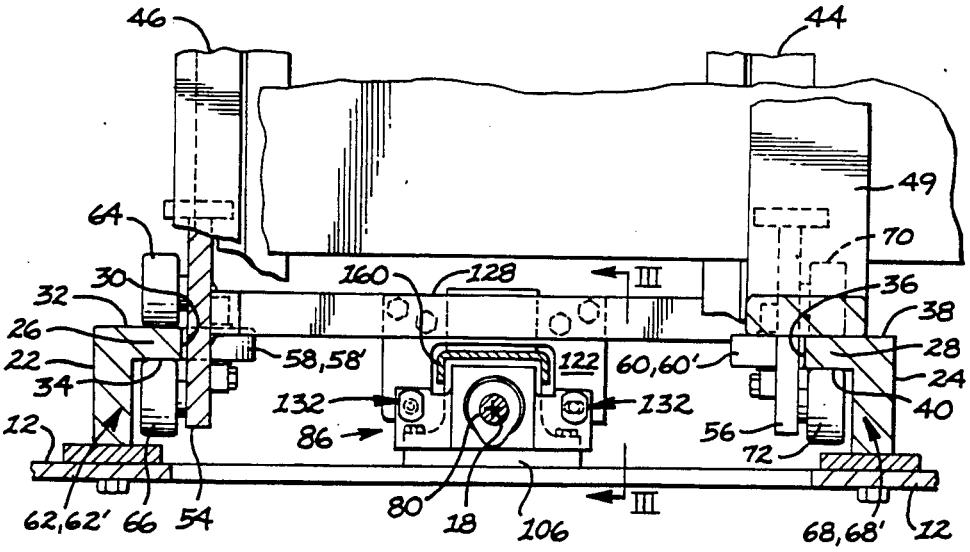
FIG. 2 is a diagrammatic partial sectional view taken along lines II—II of FIG. 1 showing a transport means for connecting the lift mast assembly to first and second spaced apart guide rails, a power means for moving the transport means along the first and second guide rails, and a coupling means for connecting the transport means to the power means.

With reference to the drawings, and particularly FIG. 1, a material handling vehicle 10 which is preferably an AGV (automatic guided vehicle) has a frame 12, and first and second spaced apart end portions 14,16. The vehicle 10 has a longitudinal vehicle axis 18 and a plurality of ground engaging wheels 20 which are rotatably connected to the frame 12 at spaced apart locations thereon.

A first elongated guide rail 22 is connected to the frame 12 and oriented in a direction substantially parallel to the longitudinal vehicle axis 18. A second elongated guide rail 24 is connected to the frame 12 at a location spaced a preselected distance from the first guide rail 22 and oriented substantially parallel to the first guide rail 22. Preferably, the first guide rail 22 has a flange 26, and the second guide rail has a flange 28. The first guide rail flange 26 has a side thrust guide surface 30 and first and second spaced apart opposed load carrying surfaces 32,34 which are connected to the side thrust guide surface 30. Similarly, the second guide rail flange 28 has a side thrust guide surface 36 and first and second spaced apart opposed load carrying surfaces 38,40 connected to the side thrust guide surface 36. Flanges 26 and 28 project inwardly and towards one another, and the side thrust guide surface 30 of the first rail 22 and the side thrust guide surface 36 of the second rail 24 are parallel to each other, face each other, and are parallel to the longitudinal vehicle axis 18.

A lift mast assembly 42 having a pair of spaced apart elevationally oriented upright guide members 44,46 and a carriage assembly 48 having a plurality of forks 49 is provided for lifting a load. The carriage assembly 48 is connected to and elevationally movable along the upright guide members 44,46 between elevationally spaced apart locations on the elevationally oriented guide members 44,46. The carriage assembly 48 is driven along the upright guide members 44,46 in any suitable manner, for example, by a jack driven chain and sheave arrangement (not shown).

A transport means 50 is provided for connecting the lift mast assembly 42 to the first and second spaced apart guide rails 22 and 24, and for guiding movement of the lift mast assembly 42 along the first and second guide rails 22 and 24 in directions substantially parallel to the longitudinal vehicle axis 18. The transport means 50 engages the side thrust guide surfaces 30,36 and limits, to a preselected amount, the amount of transverse movement relative to the longitudinal vehicle axis 18. Preferably, the transport means 50 includes a transport frame 52 which has first and second spaced apart side portions 54 and 56. A first side thrust roller 58 is rotatably connected to the first side portion 54 and rollingly engagable with side thrust guide surface 30. Similarly, a second side thrust roller 60 is rotatably connected to the second side portion 56 and rollingly engageable with the side thrust guide surface 36 of the second guide rail 28. It is to be noted that although only one side thrust roller 58,60 has been discussed with respect to each of the first and second guide rails 22,24, respectively, additional side thrust rollers 58',60' may be utilized to reduce the amount of transverse and cocking motion of the transport frame 52.

A first pair of load rollers 62 is rotatably connected to the first side portion 54 at elevationally spaced apart locations on the first side portion 54. One load roller 64 of the first pair of load rollers 62 is engageable with the first load carrying surface 32 of first guide rail 22, and the other load roller 66 of the first pair of load rollers 62 is engageable with the second load carrying surface 34 of first guide rail 22. Similarly, a second pair of load rollers 68 is rotatably connected to the second side portion 56 of transport frame 52 at elevationally spaced apart locations on the second side portion 56. One load roller 70 of the second pair of load rollers 68 is engageable with the second guide rail first load carrying surface 38, and the other load roller 72 of the second pair of load rollers 68 is engageable with the second guide rail 24 second load carrying surface 40. Although only one pair of load rollers 62,68 has been discussed with respect to each of the first and second side portions 54,56 and first and second guide rails 22,24, additional pairs of first and second pairs of load rollers 62',68' may be provided on the first and second side portions 54,56, respectively. Each pair of the pairs of load rollers 62,62',68,68' heretofore discussed are rollingly engageable with respect to an adjacent one of flanges 26,28.

Figure 3:
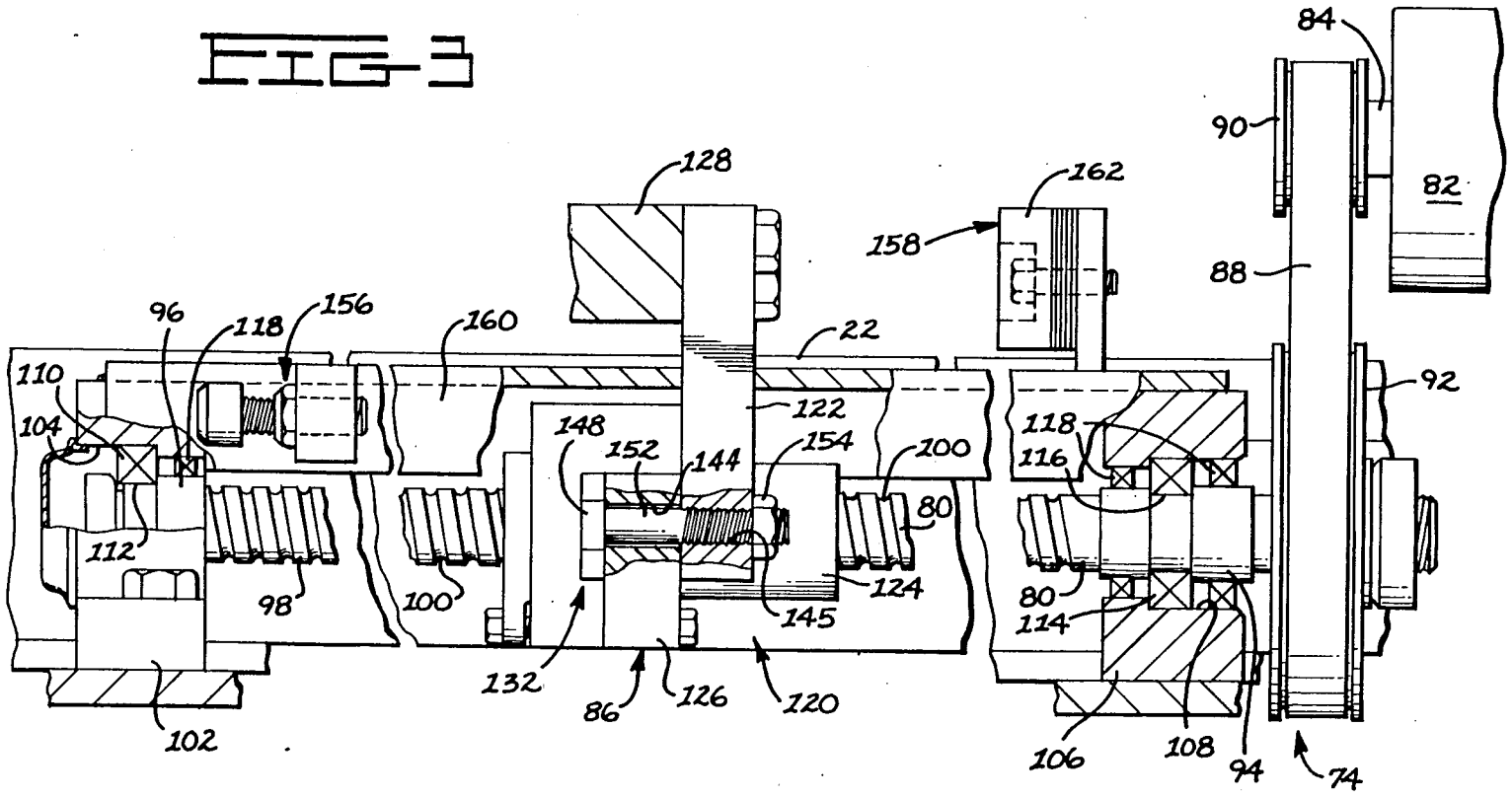
FIG. 3 is a partial sectional view taken along lines III—III of FIG. 2 showing the power means, drive means, and connecting means in substantially greater detail.
Figure 4:
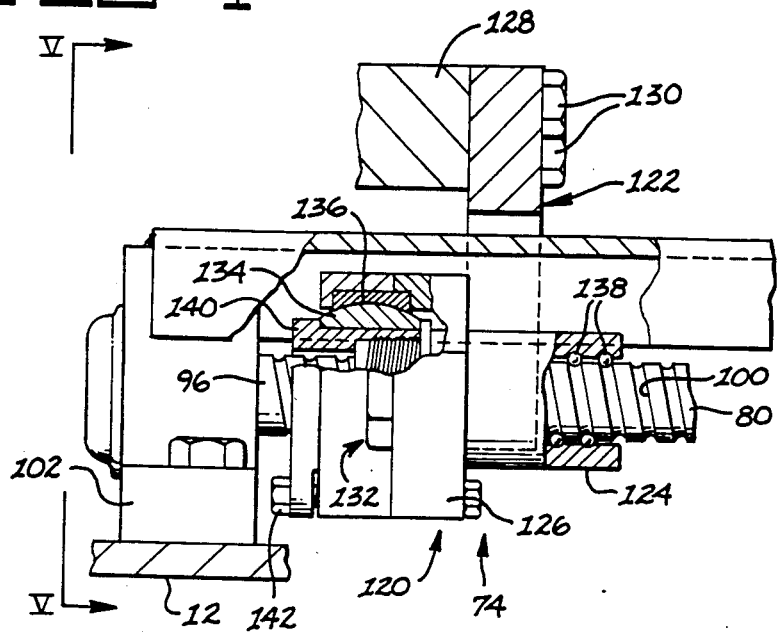
FIG. 4 is a diagrammatic view showing the power and coupling means in greater detail and at the first position of the lift mast assembly.
Figure 5:
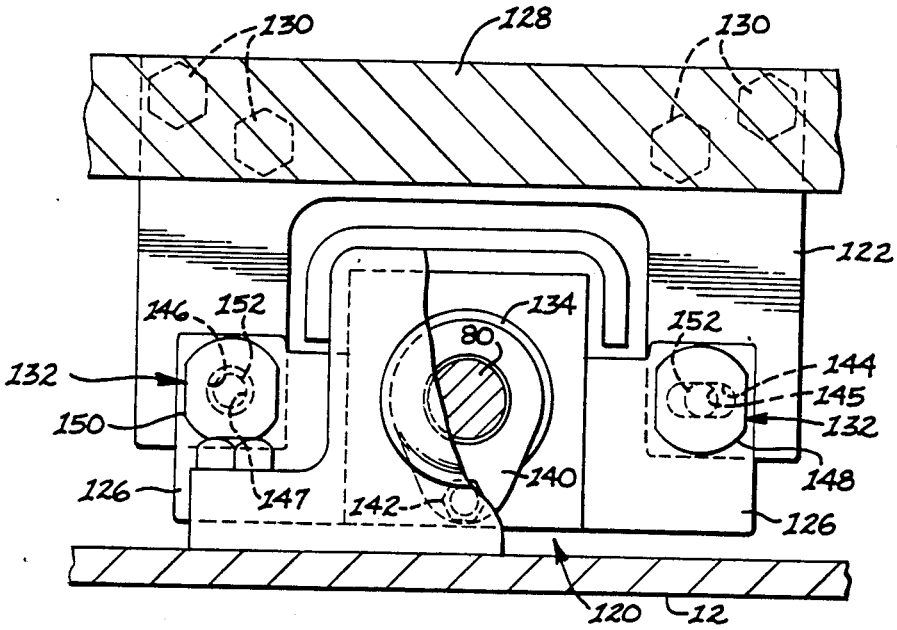
FIG. 5 is a diagrammatic end view taken along lines V—V of FIG. 4 showing the power means, coupling means, and transport means in greater detail, and with portions broken away for clarity.

As best seen in FIGS. 3 and 4, power means 74 is provided for moving the transport means 50 along the first and second guide rails 22 and 24 between a first position 76 at which the lift mast assembly 42 is adjacent the frame first end portion 14, and a second position 78 at which the lift mast assembly 42 is spaced from the first position 76 and between the first and second end portions 14 and 16. The power means 74 has a shaft 80 which is positioned between the first and second guide rails 22 and 24, and connected to the frame 12. Shaft 80 extends in a direction substantially parallel to the longitudinal vehicle axis 18. The power means 74 also includes a motor 82 having an output member 84 which is drivingly connected to the coupling means 86. The coupling means 86 is mounted on the shaft 80 and movable along the shaft 80 in response to movement of output member 84. It is to be noted that the coupling means 86 is guided by the shaft 80 for movement therealong and that the output member 84 drives the coupling means 86 in any suitable fashion.

Specifically, the output member 84 is rotatable and connected to the shaft 80 in any suitable manner, such as by a cog belt 88 which is trained about a first sheave 90 mounted on the output member 84, and a second sheave 92 mounted on a second end portion 94 of shaft 80. The shaft 80 also has a first end portion 96 which is spaced from the second end portion 94, an outer cylindrical surface 98, and a helical annular groove 100 disposed in and along the outer cylindrical surface 98.

A first bearing carrier 102, having a bore 104 disposed therein, is connected to the frame 12 at a location adjacent the first end portion 14 of the vehicle frame 12. A second bearing carrier 106, having a bore 108 disposed therein, is connected to the frame 12 at a location spaced from the first bearing carrier 102 and closely adjacent the second position 78 of the lift mast assembly 42. A first bearing 110 which has a bore 112 is mounted in the first bearing carrier bore 104, and a second bearing 114 having a bore 116 disposed therein, is mounted in the second bearing carrier bore 108. The first and second bearings 110 and 114 are preferably anti-friction bearings of a conventional design. The shaft first end portion 96 is disposed in the first bearing bore 112, and the shaft second end portion 94 is disposed in the second bearing bore 116. Preferably, shaft 80 is rotatable relative to the first and second bearing carriers 102 and 106, and lies along the longitudinal vehicle axis 18. A plurality of seals 118 are connected to the first and second bearing carriers 102 and 106, and sealingly engaged with the shaft 80 to prevent contamination of the bearings 110,114 and the leakage of lubricant from the bearings 110,114.

The coupling means 86 connects the power means 74 to the transport means 50 and provide a preselected amount of free movement of the transport means 50 relative to the power means 74 in directions transverse the first and second guide rails 22,24. The coupling means 86 includes a guiding portion 120 and a connecting portion 122. The guiding portion has a drive portion 124 and a flange portion 126 which is connected to the drive portion 124. The drive portion 124 is mounted on shaft 80, disposed in the helical groove, and movable along the shaft in response to rotation of the shaft 80. The connecting portion 122 is mounted on the transport means 50 and connected to the flange portion 126 of the guiding portion 120. The connecting portion 122 moves transport means 50 along the guide rails 22 and 24 in response to movement of the guiding portion 120 along the shaft 80. The connecting portion 122 is movable relative to flange portion 126 in directions transverse the guide rails 22 and 24, but fixed relative to the flange portion 126 in the remaining directions. The connecting portion 122 is preferably secured to a cross member 128 which is connected to the first and second side portions 54 and 56 of the transport frame 52 by a plurality of fasteners 130. The connecting portion 122 has a pair of spaced apart ears which extend from a body portion and straddle the shaft 80 for clearance purposes.

Preferably, a fastening means 132 attaches the connecting portion 122 to the flange portion 126 and maintains the connecting portion 122 for slidable movement relative to the flange portion 126 in directions transverse the first and second guide rails 22 and 24. The connecting portion 122 is movable along the shaft 80 with and in response to movement of the guiding portion 120 along the shaft 80 and between spaced apart locations on the shaft 80 in response to movement of the output member 84.

The guiding portion 120 has a spherical ball 134 connected to the drive portion 124 and a spherical seat 136 connected to the flange portion 126. The spherical seat 136 is matingly engaged with the spherical ball 134. The spherical ball 134 and spherical seat 136 permits pivotal movement of the drive portion 124 relative to the flange portion 126 in order to accommodate a preselected amount of cocking and skewing movement of the transport means 50 relative to the shaft 80.

The coupling means 86 has a plurality of spherical balls 138 which are disposed between the drive portion 124 and the shaft 80 and in helical groove 100. The balls 138 are forced to move along the helical groove in response to rotation of the shaft 80. Thus, rotary motion of the shaft 80 is converted to linear motion of the coupling means 86. The balls 138 provide a substantially friction free connection between the shaft 80 and drive portion 124.

A retainer 140 which is screwthreadably connected to the drive portion 124 connects the spherical ball 134 to the drive portion 124. A threaded fastener 142 which is connected to the drive portion 124 prevents rotation of the retainer 140 relative to the drive portion and locks the retainer 140 at the desired location.

The fastening means 132 includes first and second transversely spaced apart apertures 144,146 which are disposed in the flange portion 126, first and second transversely spaced apart apertures 145,147 which are disposed in the connecting portion 122, a first fastener 148 disposed in the first apertures 144,145 of the flange and connecting portions 126,122, and a second fastener 150 disposed in the second apertures 146,147 of the flange and connecting portions 126,122. The first fastener 148 is free to move a preselected distance relative to one of the first apertures 144,145 in the aforementioned transverse directions relative to longitudinal axis 18, and the second fastener 150 is free to move a preselected distance relative to one of the second apertures 146,147 also in the transverse directions. Preferably, the first and second connecting portion apertures 145,147 are tapped holes, and the first and second fasteners 148 and 150 are screwthreadably engaged in the first and second connecting portion apertures 145,147, respectively. The first aperture 144 in the flange portion 126 is preferably an elongated slot which is oriented in the direction transverse the first and second guide rails 22,24, and the second aperture 146 in the flange portion 126 is a cylindrical bore having a diameter of a preselected magnitude. The first and second fasteners 148 and 150 each have a cylindrical shank 152 having a diameter of a preselected magnitude. The diameter of the cylindrical shank 152 of the second fastener 150 is smaller in magnitude than the diameter of the cylindrical bore of the second flange portion aperture 146. The clamping force of the first and second fasteners 148,150 is limited so that the first and second fasteners 148,150 can freely move in the first and second flange portion apertures 144,146 and thereby permit a preselected amount of freedom of movement of the connecting portion 122 transverse the first and second guide rails 22,24. A lock nut 154 is connected to the threaded portion of each of the first and second fasteners 148,150 and prevents inadvertent rotation of the first and second fasteners 148,150 and loosening thereof. It is to be noted that the first and second fasteners extend in a direction substantially parallel to the side thrust guide surfaces 30,36 and the longitudinal axis 18. Likewise, the first and second apertures 144,145,146,147 extend through the flange and connecting portions 122,126 in directions substantially parallel to the first and second side thrust guide surfaces 30,36 and the longitudinal axis 18.

A first stop 156 is connected to frame 12 at a location adjacent the frame first end portion 14, and a second stop 158 is connected to the frame 12 at a location between the first and second frame end portions 14 and 16. Preferably, the first and second stops 156 and 158 are mounted on a shield 160 which overlies shaft 80 and is connected to the first and second bearing carriers 102 and 106. The first stop 156 is screwthreadably adjustable for precisely defining the first position 76 of the lift mast assembly 42, and the second stop 158 is shim adjustable for defining the second position 78 of the lift mast assembly 42. The first and second stops 156 and 158 engage the connecting portion 122 at the first and second positions 76 and 78 of the lift mast assembly 42, respectively. The second stop 158 has an elastomeric portion 162 which noiselessly and softly engages connecting portion 122.

Industrial Applicability

With reference to the drawings, and in operation, the material handling vehicle 10 is adapted to engage a load to be transported, lift the load being transported onto the material handling vehicle 10, transport the load to the desired location, and unload the material handling vehicle 10 at the desired location. In order to engage the load to be lifted, the lift mast assembly 42 must move from the second position 78 to the first position 76 in order to position the load engaging forks 49 beneath the load for engagement. The transport means 50 smoothly and freely guides the lift mast assembly along the first and second guide rails 22,24 from the second position 78 to the first position 76 at which the first stop 156 engages the connecting portion 122 and prevents further movement. The side thrust and load carrying rollers 58,58',60,60',62,62',68,68' ensure this free, smooth movement.

Upon engagement between the forks 49 and the load to be lifted, the carriage is elevationally moved on the uprights 44,46 so that the carriage 48 is above the first and second guide rails 22 and 24. The transport means 50 and the load and side thrust rollers 68,68',62,62',58,58',60,60' limit the amount of motion of the lift mast in directions transverse and resist cocking, twisting, and the like. The power means 74 is then actuated to rotate shaft 80 and drive the coupling means 86 along the shaft 80 towards the second position 78 of the lift mast assembly 42. Any movement of the transport means 50 in directions transverse the guide rails 22,24 is accommodated by the fastening means 132 and the relative movement between the connecting portion 122 and guiding portion 120. Thus, any side loads placed on the lift mast 42 which tend to move the transport means 50 transverse of the guide rails are accommodated by the coupling means 86. Therefore, shaft 80 is substantially free of side loadings transferred from the mast 42 through the transport means 50. It should be recognized that manufacturing tolerances dictate the necessity for a preselected amount of free movement of the transport means in directions transverse of the guide rails 22,24. As a result, the coupling means alleviates the problems that this freedom of movement creates.

The spherical ball 134 and spherical seat 136 accommodates movement of the transport means 50 in a substantial number of other directions caused by the lift mast 42 loading and clearance due to manufacturing tolerance stack up between assembled parts. This will further improve the smoothness of operation and extend the life of the component parts of the power, coupling, and transport means 74, 86, and 50.

Upon completed retraction of the lift mast 42 to the second position 78 at which the stop 158 engages connecting portion 122, the load is then ready to be transported to a deposit or unloading station wherein once again the lift mast assembly 42 will be moved from the second position 78 to the first position 76. The power means 74 and particularly the helical drive shaft 80 provide smooth and precise movement and placement of the lift mast assembly 42 between the first and second positions 76,78. The coupling means 86 and transport means 50 enable the preferred helical drive shaft 80 to be sucessfully used.

Other aspects, objects, and advantages of this invention can be obtained from a study of the drawings, the disclosure, and the appended claims.

I claim:

1. A material handling vehicle, comprising:

a frame having first and second spaced apart end portions, and a longitudinal vehicle axis extending between said first and second end portions;

a first guide rail connected to said frame, said first guide rail being substantially parallel to said longitudinal vehicle axis;

a second guide rail connected to said frame at a location spaced from said first guide rail, said second guide rail being substantially parallel to the first guide rail;

a lift mast assembly having a pair of spaced apart upright guide members, and a carriage assembly connected to and elevationally movable along said upright guide members;

transport means for connecting said lift mast assembly to said first and second guide rails and guiding movement of said lift mast assembly along said first and second guide rails in directions substantially parallel to said longitudinal vehicle axis;

power means for moving said transport means along said first and second guide rails between a first position at which said lift mast assembly is adjacent the frame first end portion, and a second position at which the lift mast assembly is spaced from the first position and between the first and second end portions; and coupling means for connecting said power means to said transport means and providing a preselected amount of free movement of the transport means relative to said power means in directions transverse to the first and second guide rails.

2. A material handling vehicle, as set forth in claim 1, wherein said power means includes:

a shaft connected to said frame and positioned at a location between the first and second guide rails, said shaft extending in a direction substantially parallel to the longitudinal vehicle axis; and a motor having an output member and being drivingly connected to said coupling means, said coupling means being mounted on said shaft and movable along said shaft in response to movement of said output member.

3. A material handling vehicle, as set forth in claim 2, wherein the output member of said motor is rotatably connected to said shaft, said shaft being rotatable in response to rotation of said output member.

4. A material handling vehicle, as set forth in claim 3, wherein said shaft has first and second spaced apart end portions and said power means includes:

a first bearing carrier having a bore and being connected to said vehicle frame;

a first bearing having a bore and being mounted in said first bearing carrier bore;

a second bearing carrier having a bore and being connected to said vehicle frame at a location spaced from said first bearing carrier; and a second bearing having a bore and being mounted in the second bearing carrier bore, said shaft first end portion being disposed in the first bearing bore and said shaft second end portion being disposed in the second bearing bore.

5. A material handling vehicle, as set forth in claim 3, wherein said shaft has an outer cylindrical surface and a helical groove disposed about and along said outer cylindrical surface, and wherein said coupling means includes:

a guiding portion having a drive portion and a flange portion connected to said drive portion, said drive portion being mounted on said shaft, engageable with said helical groove, and movable along said shaft in response to rotation of said shaft; and a connecting portion mounted on said transport means and connected to the flange portion of said guiding portion, said connecting portion moving said transport means along said rails in response to movement of said guiding portion along said shaft, said connecting portion being movable relative to said flange portion in said directions transverse to said guide rails.

6. A material handling vehicle, as set forth in claim 5, wherein the flange and connecting portions each have first and second spaced apart apertures disposed therein and wherein said connecting portion includes:

a first fastener disposed in the first aperture of the flange and connecting portions; and a second fastener disposed in the second aperture of the flange and connecting portions.

7. A material handling vehicle, as set forth in claim 6, wherein said first aperture of one of the flange and connecting portions being an elongate slot oriented in a direction transversely of the first and second guide rails, and the second aperture in one of the flange and connecting portions being a cylindrical bore having a diameter of a preselected magnitude, said second fastener having a cylindrical shank, said cylindrical shank of the second fastener having a diameter of a preselected magnitude, said cylindrical shank diameter being smaller in magnitude than the cylindrical bore diameter of the second aperture.

8. A material handling vehicle, as set forth in claim 2, wherein said first and second guide rails each include a flange having first and second opposed load carrying surfaces and a side thrust guide surface, and said transport means includes:

a transport frame having first and second spaced apart side portions;

a first side thrust roller connected to said first side portion and engageable with said first guide rail side thrust guide surface;

a second side thrust roller connected to said second side portion and engageable with said second guide rail side thrust guide surface;

a first pair of load rollers connected to the first side portion at elevationally spaced apart locations on said first side portion, one load roller of the first pair of load rollers being engageable with the first guide rail first load carrying surface and the other load roller of the first pair of load rollers being engageable with the first guide rail second load carrying surface; and a second pair of load rollers connected to the second side portion at elevationally spaced apart locations on said second side portion, one load roller of the second pair of load rollers being engageable with the second guide rail first load carrying surface, and the other load roller of the second pair of load rollers being engageable with the second guide rail second load carrying surface.

9. A material handling vehicle, as set forth in claim 2, wherein said coupling means includes:

a guiding portion having a drive portion and a flange portion, said guiding portion being mounted on said shaft and movable along said shaft between spaced apart locations on said shaft in response to movement of said output member;

a connecting portion mounted on said transport means and engaged with the flange portion of said guiding portion; and fastening means for connecting the connecting portion to the flange portion and maintaining said connecting portion for slidable movement relative to the flange portion in said directions transverse to said guide rails, said connecting portion being movable along said shaft with and in response to movement of the guiding portion along said shaft.

10. A material handling vehicle, as set forth in claim 9, wherein said fastening means includes:

first and second spaced apart apertures disposed in each of the flange and connecting portions;

a first fastener disposed in the first aperture of the flange and connecting portions, and a second fastener disposed in the second aperture of the flange and connecting portions, said first fastener being free to move a preselected distance relative to one of the first apertures in said transverse directions and said second fastener being free to move a preselected distance relative to one of the second apertures in said transverse directions.

11. A material handling vehicle, as set forth in claim 5, wherein said guiding portion includes:

a spherical ball connected to said drive portion; and a spherical seat connected to said flange portion and being matingly engaged with said spherical ball, said drive portion being pivotally movable relative to said flange portion.

12. A material handling vehicle, as set forth in claim 11, wherein said coupling means includes a plurality of balls located between the drive portion and said shaft, said balls being disposed in the helical groove in said shaft.

13. A material handling vehicle, as set forth in claim 1, including:

a first stop connected to the frame at a location on the frame adjacent the first end portion of the frame, said transport means being engageable with the first stop at the first position of the transport means; and a second stop connected to the frame at a location on the frame between the first and second end portions, said transport means being engageable with the second stop at the second position of the transport means.

14. The material handling vehicle, as set forth in claim 12, including a shield connected to said frame and overlying said shaft, said first and second stops each being connected to said shield and said second stop having an elastomeric portion.

15. An automatic guided vehicle, comprising:

a frame having first and second spaced apart end portions, and a longitudinal vehicle axis;

a first guide rail having a side thrust guide surface and being connected to the frame, said first guide rail side thrust guide surface being substantially parallel to said longitudinal vehicle axis;

a second guide rail having a side thrust guide surface and being connected to said frame, said second guide rail side thrust guide surface being substantially parallel to the first guide rail side thrust guide surface and spaced from the first guide rail side thrust guide surface;

a lift mast assembly having a pair of spaced apart elevationally oriented upright guide members, and a carriage assembly connected to and elevationally movable along said upright guide members;

transport means for connecting said lift mast assembly to said first and second guide rails and movably guiding said lift mast assembly along said first and second guide rails in directions substantially parallel to said side thrust guide surfaces, said transport means being engageable with said side thrust guide surfaces;

a shaft having first and second spaced apart end portions and being connected at said first and second shaft end portions to said frame, said shaft being substantially parallel to said longitudinal vehicle axis;

a coupling having a guiding portion mounted on and movable along said shaft, and a connecting portion mounted on and movable with said transport means, said connecting portion being connected to said guiding portion and movable in response to movement of said guiding portion along said shaft, said connecting portion being movable relative to the guiding portion in directions transverse to the side thrust guide surface of the first and second rails in response to movement of the transport means in said directions transverse of said side thrust guide surfaces; and power means for moving said coupling along said shaft between a first position at which the lift mast assembly is adjacent the frame first end portion and a second position at which the lift mast assembly is spaced from said first position and between the first and second frame end portions.

16. An automatic guided vehicle, as set forth in claim 15, wherein said power means includes a continuous helical groove disposed about and along said shaft, and a drive motor connected to the second end portion of said shaft, said drive motor being adapted to rotate said shaft, said guiding portion includes:

a drive portion disposed about the shaft, engageable with the continuous helical groove, and movable along said shaft in response to rotation of said shaft;

a flange portion connected to the drive portion and movable with said drive portion along said shaft; and fastening means for connecting the flange portion to the connecting portion, maintaining said flange portion from longitudinal movement relative to said connecting portion, and freeing said connecting portion for slidable movement relative to the flange portion in said transverse directions.

17. An automatic guided vehicle, as set forth in claim 16, wherein said transport means includes:

a transport frame having first and second spaced apart side portions;

first and second side thrust rollers connected to said transport frame first and second side portions, respectively, said first side thrust roller being engageable with the first guide rail side thrust guide surface and said second side thrust roller being engageable with the second guide rail side thrust guide surface; and a plurality of load rollers connected to one of said first and second spaced apart frame side portions and engageable with the adjacent one of said first and second guide rails, said load rollers guiding said transport frame along said guide rails.

18. An automatic guided vehicle, as set forth in claim 17, wherein said transport frame includes a cross member connected to the first and second side portions, said connecting portion being connected to said cross member.

19. An automatic guided vehicle, as set forth in claim 17, wherein said fastening means includes:

first and second spaced apart apertures disposed in the flange portion;

first and second fasteners connected to the connecting portion at spaced apart locations thereon and extending from the connecting portion in a direction substantially parallel to said side thrust guide surfaces, said first fastener being disposed in the first aperture and said second fastener being disposed in the second aperture, said first and second fasteners being movable in the first and second apertures in said directions transverse to the side thrust guide surfaces and relative to the connecting portion.

20. An automatic guided vehicle, as set forth in claim 19, including:

a first stop connected to the frame at a location adjacent the frame first end portion; and a second stop connected to the frame at a location between the frame first and second end portions, said transport frame being engageable with the first stop at the first position of the lift mast assembly and engageable with the second stop at the second position of the lift mast assembly.

* * * * *